US005833937A

United States Patent [19]

Kerr

[11] Patent Number: 5,833,937

[45] Date of Patent: Nov. 10, 1998

[54] POLYMERIC COMBINATIONS USED AS COPPER AND PRECIOUS METAL HEAP LEACHING AGGLOMERATION AIDS

[75] Inventor: E. Michael Kerr, Aurora, Ill.

[73] Assignee: Nalco Chemical Company, Naperville, Ill.

[21] Appl. No.: 953,426

[22] Filed: Oct. 17, 1997

[51] Int. Cl.[6] ..... C22B 11/00; C22B 15/00

[52] U.S. Cl. ..... 423/27; 423/29; 75/723; 75/772

[58] Field of Search ..... 423/27, 29; 75/723, 75/743, 772

[56] References Cited

U.S. PATENT DOCUMENTS

| | | | |
|---|---|---|---|
| 4,342,653 | 8/1982 | Halverson | 210/734 |
| 4,587,108 | 5/1986 | MacDonald | 423/11 |
| 4,767,449 | 8/1988 | Rosen et al. | 75/772 |
| 4,786,318 | 11/1988 | Owen et al. | 423/26 |
| 4,802,914 | 2/1989 | Rosen et al. | 75/772 |
| 4,875,935 | 10/1989 | Gross et al. | 423/27 |
| 4,898,611 | 2/1990 | Gross | 423/27 |
| 5,077,022 | 12/1991 | Polizzotti | 423/29 |
| 5,100,631 | 3/1992 | Gross | 423/29 |
| 5,186,915 | 2/1993 | Polizzotti | 423/29 |
| 5,196,052 | 3/1993 | Gross et al. | 423/29 |
| 5,211,920 | 5/1993 | Polizzotti | 423/29 |
| 5,512,636 | 4/1996 | Polizzotti et al. | 423/27 |
| 5,668,219 | 9/1997 | Polizzotti et al. | 423/29 |

OTHER PUBLICATIONS

"Technical Innovations Spur Resurgence of Copper Solution Mining", J. B. Hiskey, Mining Engineering, pp. 1036–1039, Nov. 1986.

"Evaluation of Copper Dump and Head Leaching Situations", J.M. Keane/C. K. Chase, Mining Engineering, pp. 197–200, Mar. 1987.

*Primary Examiner*—Steven Bos

*Attorney, Agent, or Firm*—Kelly L. Cummings; Thomas M. Breininger

[57] ABSTRACT

An improved method for extracting a precious metal from mineral fines by heap leaching with dilute sulfuric acid which comprises agglomerating the mineral fines prior to formation into a heap with an agglomerating agent composition comprising sequential addition of a first polymer selected from the group consisting of anionic and nonionic water-soluble polymers and then a second cationic water-soluble polymer to the fines. Preferred first polymers are poly(acrylamide) and 70/30 mole percent poly(acrylamide/sodium acrylate), and preferred second polymers are poly (diallyldimethylammonium chloride), 90/10 mole percent poly(acrylamide/diallyldimethylammonium chloride) and 99/1 mole percent poly(diallyldimethylammonium chloride/vinyltrimethoxysilane).

26 Claims, No Drawings

POLYMERIC COMBINATIONS USED AS COPPER AND PRECIOUS METAL HEAP LEACHING AGGLOMERATION AIDS

FIELD OF THE INVENTION

An improved method for extracting a precious metal from mineral fines by heap leaching with dilute sulfuric acid which comprises agglomerating the mineral fines prior to formation into a heap with an agglomerating agent composition comprising sequential addition of a first water-soluble polymer and then a second water-soluble polymer to the fines. Preferred first polymers are poly(acrylamide) and 70/30 mole percent poly(acrylamide/sodium acrylate), and preferred second polymers are poly (diallyldimethylammonium chloride), 90/10 mole percent poly(acrylamide/diallyldimethylammonium chloride) and 99/1 mole percent poly(diallyldimethylammonium chloride/vinyltrimethoxysilane).

BACKGROUND OF THE INVENTION

Desirable metals (such as gold, silver, copper, aluminum, uranium, and the like) are generally found as mineral constituents in naturally occurring ores. The most common method of separating the desirable metal values from the remaining undesirable constituents, often called the "gangue," is by chemical leaching of the ore, wherein ground or crushed ore is subjected to treatment with chemical solutions containing reagents capable of selectively solubilizing the desired metal constituents while leaving the gangue material intact. The leach solution is then treated in recovery and refining operations to obtain the metal values in a purified form.

The actual mechanism of leaching may involve simple dissolution made possible by administration of a suitable solvent, or, more commonly, involves dissolution made possible by a chemical reaction. The efficiency and rate of leaching depends upon many factors, including the rate at which the leach solution is administered, the amount of metal in the ore, and the conduciveness of the ore to leaching.

Some ores are quite permeable to leach solutions; hence, relatively large ore particles can be effectively leached. Many ores are, however, rather impermeable; as a result, the ore must be reduced to a small size before leaching in order to increase the surface area of the ore and to decrease the requirement for the leach solution to penetrate deeply into the ore particles.

Various methods of leaching metal ores have been developed, including the methods known as waste dump leaching, heap leaching, vat leaching, agitation leaching, and most recently thin layer leaching.

Because of its gross inefficiency "waste dump" leaching has been used principally in connection with low-grade copper ores or pit wastes. The waste dump leaching method consists of stacking uncrushed ore into large, deep heaps (for example, 50 to 200 feet in depth) and percolating an acid and ferric sulfate leach liquor through the heaps so as to dissolve copper sulfide. The primary advantage of waste dump leaching is its low cost, which makes this method commercially feasible for use with low-grade ores despite its inefficiency in recovering the metal values from the ore. However, the inefficiency of the waste dump method makes it entirely unsuitable for use with higher-grade ores. "Heap" leaching is a term used to describe a leaching process in which the ores are placed onto what is commonly known as a "pad." Generally, the pad consists of impermeable clay, and the crushed ore to be leached is stacked on the pad to a depth of between about 12 and about 30 feet. The ore is then leached by spraying a leach solution onto the top of the heap in order to create a downward percolation of the leach solution.

When leaching by percolation, the size of the ore particles is very important. If the particles are too large, the leach solution will not penetrate to the interior of the particles, and leaching is thus incomplete. Further, use of large particles typically results in a rapid percolation rate, thereby causing leach solution to pass through the heap too quickly. On the other hand, if the particles are too small, although the ore will be effectively penetrated by the leach solution, the percolation rate may become so slow as to be impractical.

The solution for dealing with particles that are too large for effective leaching is simply to reduce them in size. Conversely, undersize particles in gold oxide ores may be "agglomerated," such as by the addition of Portland cement, in order to increase the percolation rate through the heap. The use of Portland cement is only for the treatment of gold oxide ores.

One serious problem that has plagued conventional heap leach processes is the difficulty in obtaining a uniform leach throughout the heap. Typically, the upper layer ore in such a heap is over-leached while the lower layer ore is inadequately leached.

Yet another problem when using a heap leach process is the difficulty in leaching the sides of the heap, especially when the heap consists of ores having low permeabilities of fine ores that are easily eroded. When leaching these types of ores, there is a tendency for the leach solution to run down the side of the heap rather than percolate through the heap.

In a heap leaching process, while the leach solution effluent is relatively rich in metal values initially, it often becomes quite weak as leaching continues over a period of weeks or months. This is particularly significant when it is realized that heaps of the type described above are typically leached for somewhere between a month and a year. The recovery facilities must be constructed so as to be capable of handling the relatively rich solutions obtained initially, even though this means that the recovery facilities are utilized during the later period of time when the leach solutions become less concentrated with metal values.

Copper is extracted from various minerals such as malachite, azurite, chrysocolla and cuprite by heap leaching with dilute solutions of sulfuric acid. In this method of heap leaching, the copper minerals or copper ores are crushed to obtain particles of about 1 inch in diameter, agglomerated by spraying with a dilute aqueous solution of sulfuric acid, which agglomerates the particles which particles are then stacked and layered to a depth ranging between about 10–20 feet. The dilute sulfuric acid solutions which are used to agglomerate the crushed ore normally contain between 10–60 pounds of concentrated sulfuric acid per ton of ore dissolved in water. After the stack has been formed, dilute sulfuric acid containing from about 10 grams sulfuric acid per liter of solution to about 100 grams sulfuric acid per liter of solution is then sprayed onto and allowed to percolate down through the heaped pile of copper mineral ores. During this percolation of the extract solution, copper is dissolved from the ore bodies extracting copper values therefrom and the extracted solution containing these copper values is drawn off at the bottom of the heap to be further processed by such techniques as solvent extraction, electrowining and the like.

Further descriptions of the heap leaching of copper ores and references available teaching this heap leaching technique may be obtained in the following two articles "Technical Innovations Spur Resurgence of Copper Solution Mining", J. B. Hiskey, *Mining Engineering,* pages 1036–1039, November 1986 and "Evaluation of Copper Dump and Heap Leaching Situations", J. M. Keane and C. K. Chase, *Mining Engineering,* pages 197–200, March, 1987.

The major problem observed in the heap leaching of these copper ores and copper minerals is the segregation of mineral fines in building the heap and migration of these mineral fines during the percolation of the extracting sulfuric acid solutions which results in channeling of the leach solution and/or blinding of the heap. These blinding and channeling processes may cause areas of the heap to be dry and unexposed to the leaching solutions therefore yielding low recovery of copper and over-extraction of some undesirable mineral components.

There are several examples of anionic polymeric agglomeration aids for the recovery of precious metals. Useful anionic polymers which are typically copolymers of acrylamide and acrylic acid have been disclosed in U.S. Pat. Nos. 4,898,611; 5,077,022; 5,100,631; 5,186,915 and 5,211,920. Anionic co- or ter-polymers made from 2-acrylamido-2-methyl propane sulfonic acid are disclosed in U.S. Pat. Nos. 4,342,653; 4,786,318 and 4,875,935. A combination of polyacrylamide and a copolymer of acrylamide with 2-acrylamido-2-methyl propane sulfonic acid as a flocculating agent is disclosed in U.S. Pat. No. 4,587,108. Cationic agglomerating agents including graft copolymers of acrylamide and diallyl dimethyl ammonium chloride have been disclosed in U.S. Pat. No. 5,512,636. Various other cationic polymers have been disclosed as agglomerating agents in U.S. Pat. Nos. 4,898,611 and 5,100,631. However, none of these references disclose a combination of cationic and anionic polymers to aid the agglomeration process as described herein. Such a combination demonstrates a marked improvement in efficiency, which will be illustrated in the following examples.

SUMMARY OF THE INVENTION

An improved method for extracting a precious metal from mineral fines by heap leaching with dilute sulfuric acid which comprises agglomerating the mineral fines prior to formation into a heap with an agglomerating agent composition comprising sequential addition of a first water-soluble polymer selected from the group consisting of anionic and nonionic water-soluble polymers and then a second cationic water-soluble polymer to the fines. Preferred first polymers are poly(acrylamide) and 70/30 mole percent poly (acrylamide/sodium acrylate), and preferred second polymers are poly(diallyldimethylammonium chloride), 90/10 mole percent poly(acrylamide/diallyldimethylammonium chloride) and 99/1 mole percent poly (diallyldimethylammonium chloride/vinyltrimethoxysilane).

DESCRIPTION OF THE INVENTION

The invention is utilized in a process for percolation leaching of minerals from a mineral bearing ore wherein the ore is first agglomerated with an agglomeration agent, formed into a heap and then leached by percolating a leaching solution through the heap which extracts the minerals from the agglomerated ore for subsequent recovery, the improvement in which the agglomerating agent comprises sequential addition of a first water-soluble polymer and then a second water-soluble polymer to said ore.

For the practice of any aspect of this invention, the second polymer may be formed from the polymerization of monomers of (meth)acrylamide with monomers selected from the group consisting of 2-acryloyloxyethyl trimethyl ammonium chloride, 3-methacrylamido propyl trimethyl ammonium chloride, 2-methacryloyloxyethyl trimethyl ammonium chloride, vinyl acetate, diallyldimethyl ammonium chloride, vinyl pyrrolidinone, acrylonitrile, dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, dimethylaminoethylmethacrylate methyl sulfate quaternary salt, and combinations thereof.

Also, for the practice of any aspect of this invention, the first polymer may be formed from the polymerization of monomers of (meth)acrylic acid with monomers selected from the group consisting of acrylonitrile, acrylic acid and salts thereof, methacrylamide and salts thereof, $C_1$–$C_{10}$ N-alkyl acrylamide, $C_1$–$C_{10}$ N,N-dialkyl acrylamide, $C_1$–$C_{10}$ N-alkyl methacrylamide, $C_1$–$C_{10}$ N, N-dialkyl methacrylamide, N-aryl acrylamide, N,-N-diaryl acrylamide, N-aryl methacrylamide, N-N-diaryl methacrylamide, N-arylalkyl acrylamide, N,N-diallylalkyl acrylamide, N-arylalkyl methacrylamide, N,N-diarylalkyl methacrylamide, maleic anhydride, itaconic acid, vinyl sulfonic acid, styrene sulfonic acid, sodium acrylamido methyl propane sulfonic acid, maleic acid and combinations thereof.

In any aspect of this invention, the second polymer may be a homopolymer formed from monomers selected from the group consisting of: dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, and dimethylaminoethylmethacrylate methyl sulfate quaternary salt. For any aspect of this invention, the first polymer may be poly(acrylamide).

For any aspect of this invention, the second polymer may be selected from the group consisting of a polymeric reaction product of ethylenedichloride and ammonia including the associated methyl chloride and dimethyl sulfate quaternary amine salts; a polymeric reaction product of epichlorohydrin and dimethylamine; a polymeric reaction product of epichlorohydrin, dimethylamine and ethylenediamine including the associated methyl chloride or methyl sulfate quaternary amine salts; a polymeric reaction product of epichlorohydrin, dimethylamine and ammonia including the associated methyl chloride chloride or methyl sulfate quaternary amine salts; a polymeric reaction product of epichlorohydrin, dimethylamine hexamethylenediamine including the associated methyl chloride or methyl sulfate quaternary amine salts; guanidine-formaldehyde condensation polymers; cyanoguanidine-formaldehyde condensation polymers; urea-formaldehyde condensation polymers and polyethyleneimines.

Moreover, for the practice of any aspect of this invention, the agglomerating agent may be a second polymer which is poly(diallyldimethylammonium chloride) and a first polymer which is poly(acrylamide/sodium acrylate); or a second polymer which is poly(diallyldimethylammonium chloride/ vinyltrimethoxysilane) and a first polymer which is poly (acrylamide/sodium acrylate); or a second polymer which is poly(diallyldimethylammonium chloride) and a first polymer which is poly(acrylamide/sodium acrylate); or a first polymer which is poly(acrylamide) and a second polymer which is poly(diallyldimethylammonium chloride/acrylamide).

For the practice of any aspect of this invention, the amount of agglomerating agent may be in the range of about 0.05 to about 1.0 pounds per ton based on the weight of the ore; or preferably, the amount of agglomerating agent may be in the range of about 0.1 to about 0.3 pounds per ton based on the weight of the ore; the ore may be selected from the group consisting of gold, silver and copper ores. If the ore is gold ore, the agglomerating agent may be combined with at least 1 to 30 pounds per ton of cement based on the weight of the ore for the alkaline cyanide heap leach. Also, the range of the ratios for flocculant to coagulant may be envisaged as, but are not limited to, from about 50:50 to about 95:5.

Another aspect of the invention is in a process for percolation leaching of copper from a copper bearing ore wherein the ore is first agglomerated with an agglomeration agent, formed into a heap and then leached by percolating a leaching solution through the heap which extracts the copper from the agglomerated ore for subsequent recovery, the improvement in which the agglomerating agent comprises a sequential addition of a first water-soluble polymer and then a second water-soluble polymer to said ore.

The order of addition is important. In most cases, the first polymer should be added first, followed by the second polymer. However, under some circumstances, it may be beneficial to add the designated second water-soluble polymer before addition of the first water-soluble polymer to said ore.

The term (meth)acrylic acid as utilized herein signifies methacrylic acid or acrylic acid, and is meant to encompass also salts thereof such as sodium acrylate. The polymers are applied from dilute solutions of sulfuric acid or from water. The concentration of polymers in the dilute solution may vary between 0.001 to 5% by weight and preferably 0.03 to 0.2%. The term dilute sulfuric acid solution as used herein and in the claims is meant to include sulfuric acid solutions having a concentration between 5–100 g/l of sulfuric acid. In most instances, the acid concentration will be about 20 g/l.

One method of agglomeration is to spray the solution containing the polymers onto the ore in a rotating agglomeration drum or pelletizing disc in a manner to get uniform distribution over the ore. The tumbling ore upon addition of liquid will agglomerate with fines attaching to the larger particles or the fines will attach to one another and grow to larger porous particles. Sulfuric acid may be sprayed onto the ore either before or after agglomeration.

A second method of agglomeration is to spray the solution containing the polymers onto the ore at conveyor belt transfer points to get uniform distribution over the ore. The tumbling action at these and subsequent transfer points will cause the ore to agglomerate.

Rakes can also be used on the transfer belts to cause further agitation and agglomeration of the ore. Sulfuric acid may be sprayed onto the ore either before or after agglomeration.

The polymers may be used alone to agglomerate the ore fines or they may be used in conjunction with known inorganic agglomerating agents such as lime, or Portland cement (for gold oxide ores). When the polymers are used alone, a typical dosage range is with the weight percentage range of 0.05 to 1.0 pounds per ton based on the weight of the ores treated.

When the polymers are used in conjunction with an alternative inorganic agglomerating agent such as cement, the inorganic is added in the range of 1 to 30 pounds per ton of ore and the polymer is in the range of 0.05 to 1.0 pounds per ton of ore.

Dosage cannot be set forth with any degree of precision since it depends upon the polymer and the particular ore treated.

The following examples are presented to describe preferred embodiments and utilities of the invention and are not meant to limit the invention unless otherwise stated in the claims appended hereto.

EXAMPLE 1

To determine the effectiveness of this treatment to aid the leaching process, samples of <½ inch crush size gold-containing ore obtained from a western mining facility were placed in several 6" ID biruet columns. The polymeric treatments tested were made up as 1% polymer inverts in synthetic tap water. For each polymer tested, the 1% solution was added in a 0.25 lb/ton dosage to each test column. 1–2.5% of a sulfuric acid leaching solution was also added to each test column. All of the polymers tested are available from Nalco Chemical Company of Naperville, Ill. After aging for 24 hours, an initial heap height of the treated ore was measured. Eluent was collected at a rate of 3.7 mls/min. for 10 days and recirculated through the column. The heap height was then remeasured after 24, 48 and 73 hours and at the end of the evaluation. Throughout the test, the pH was approximately 1.8 to 2.0.

The results of the test are detailed in Table I. % slump is calculated from the percentage of change between the initial height and the final height at the end of the evaluation. A lower % slump value is preferable because less compression of the ore in the column which gives higher recoveries. The density of the treated ore on the column is measured by volume and weight after treatment, in comparison to the column and weight before treatment (the weight of the ore in pounds divided by the cubic feet of space in the column occupied by the ore sample. A smaller change in the ore density is advantageous to the leaching process because there is less radial compression of the ore which gives better extractant flow through the ore sample. The combinations of this invention were compared to conventional single polymer treatments. G, a low molecular weight cationic polymer was not tested alone because it is well known that such low molecular weight cationic polymers would not have activity in this type of system. The results indicate that the combination of cationic and anionic polymers are more effective than a single polymeric agglomerating treatment agent.

TABLE I

Column Test

| Treatment | Weight Ore (lbs) | Initial Height (Inches) | Final Height (Inches) | % Slump | Initial Density lbs/Cubic Ft. | Final Density lbs/Cubic Ft. | Density % Diff. |
|---|---|---|---|---|---|---|---|
| None | 39.70 | 27.00 | 20.50 | 24.07 | 89.88 | 118.37 | 31.71 |
| A | 41.80 | 28.50 | 22.00 | 22.81 | 89.65 | 116.14 | 29.55 |
| B | 41.80 | 29.00 | 24.50 | 15.52 | 88.10 | 104.29 | 18.37 |
| C | 38.60 | 26.00 | 21.00 | 19.23 | 90.75 | 112.35 | 23.81 |
| D | 40.70 | 27.75 | 21.75 | 21.62 | 89.65 | 114.38 | 27.59 |
| E | 40.40 | 28.00 | 22.25 | 20.54 | 88.19 | 110.99 | 25.84 |
| F | 39.70 | 27.75 | 23.00 | 17.12 | 87.45 | 105.51 | 20.65 |
| 0.9 C/0.1 G | 39.70 | 26.50 | 22.50 | 15.09 | 91.57 | 107.85 | 17.78 |

A = 70/30 mole ratio poly(acrylamide/sodium acrylate), 20–22,000,000 MW; liquid anionic polymer
B = poly(acrylamide); liquid nonionic polymer
C = 70/30 mole ratio poly(acrylamide/sodium acrylate), 25–30,000,000 MW; liquid anionic polymer
D = 60/40 mole ratio poly(acrylamide/sodium acrylate), 25–30,000,000 MW; liquid anionic polymer
E = 50/50 mole ratio poly(diallyldimethylammonium chloride/acrylamide) 1–1,500,000 MW; latex cationic polymer
F = 90/10 mole ratio poly(acrylamide/diallyldimethylammonium chloride) 10–15,000,000 MW: latex cationic polymer
G = 20% solution poly(diallyldimethylammonium chloride), liquid cationic polymer, 30–150,000 MW

EXAMPLE 2

Polymeric treatments were evaluated for their utility as agglomeration aids in the following manner. Test copper ore was obtained from a western mining facility. To prepare the ore for testing, it was first screened to <½". The screened ore was then mixed in a small cement mixer. A solution of the polymeric treatment to be tested and concentrated sulfuric acid was then sprayed onto the mixture of ore cascading within the cement mixer to form agglomerates. The composition to be tested was added to the spray water to get good mixing throughout the ore. Subsequent to the spray treatment, the agglomerates were added to 6" diameter leach column, then aged for 24 to 48 hours. Additional 10 g/l sulfuric acid solution was pumped to the top of the column containing the treated ore and allowed to percolate down through the ore. The eluent pregnant solution was collected from an exit tube at the bottom of the column and analyzed for mineral values.

The treatment is more efficient as the percentage of copper which was extracted increases. The agglomerates of fine particles allows the sulfuric acid to flow through more of the ore body without restrictions due to the migration of fine particles of ore and reduced clay swelling that will block the intestacies in the column. This blockage will reduce the surface area of ore that is available for extraction. The agglomeration of the ore gives more copper or gold metal extracted in the same amount of time with no increase in process time. This provides higher efficiency in ore extraction. The combinations of this invention were compared to conventional single polymer treatments. Here also, polymer G was not tested alone because it is well known that low molecular weight cationic polymers acting alone will not have an effect in these systems. The results of Table II indicate that the combination of cationic and anionic polymers are more effective than a single polymeric agglomerating treatment agent, since a greater percentage of copper is leached from the column with the combination.

TABLE II

Heap Leach Test Field Trial at a Midwestern Mining Facility

| Treatment | Hrs | Mls | % Cu | Days |
|---|---|---|---|---|
| None | 31 | 5375 | 56.24 | 0.92 |
| None | 55 | 5700 | 62.12 | 1.89 |
| None | 79 | 6250 | 64.36 | 2.96 |
| None | 132 | 12910 | 67.74 | 5.16 |
| None | 180 | 11525 | 69.25 | 7.13 |
| None | 225 | 11356 | 70.73 | 9.06 |
| None | 282 | 14237 | 72.60 | 11.49 |
| A | 31 | 5390 | 61.51 | 0.98 |
| A | 55 | 5410 | 68.20 | 1.97 |
| A | 79 | 5780 | 70.06 | 3.02 |
| A | 132 | 12100 | 72.59 | 5.23 |
| A | 180 | 10725 | 74.49 | 7.18 |
| A | 225 | 10600 | 76.02 | 9.11 |
| A | 282 | 13378 | 77.74 | 11.55 |
| B | 31 | 5825 | 59.35 | 1.00 |
| B | 55 | 5775 | 68.55 | 1.98 |
| B | 79 | 6150 | 70.90 | 3.04 |
| B | 132 | 12700 | 74.13 | 5.21 |
| B | 180 | 11350 | 76.30 | 7.15 |
| B | 225 | 11150 | 77.90 | 9.06 |
| B | 282 | 14011 | 79.46 | 11.45 |
| C | 31 | 5075 | 62.56 | 0.97 |
| C | 55 | 5175 | 68.19 | 1.95 |
| C | 79 | 5550 | 70.41 | 3.01 |
| C | 132 | 11575 | 72.82 | 5.21 |
| C | 180 | 10450 | 74.16 | 7.20 |
| C | 225 | 10275 | 75.47 | 9.15 |
| C | 282 | 13016 | 76.93 | 11.63 |
| D | 31 | 5120 | 61.53 | 0.98 |
| D | 55 | 5150 | 67.56 | 1.96 |
| D | 79 | 5530 | 70.12 | 3.01 |
| D | 132 | 11650 | 73.35 | 5.24 |
| D | 180 | 10525 | 74.81 | 7.24 |
| D | 225 | 10300 | 76.23 | 9.21 |
| D | 282 | 13198 | 77.86 | 11.73 |
| F | 13.5 | 1715 | 44.14 | 0.32 |
| F | 22.5 | 1980 | 65.49 | 0.69 |
| F | 88.5 | 15260 | 73.59 | 3.52 |
| F | 139 | 11285 | 76.49 | 5.61 |
| F | 193 | 12366 | 78.28 | 7.91 |
| F | 261 | 15522 | 80.53 | 10.79 |
| 0.9C/0.1G | 13.5 | 1975 | 50.84 | 0.35 |
| 0.9C/0.1G | 22.5 | 2100 | 70.09 | 0.72 |
| 0.9C/0.1G | 88.5 | 16041 | 81.19 | 3.55 |
| 0.9C/0.1G | 139 | 11890 | 84.25 | 5.66 |
| 0.9C/0.1G | 193 | 13144 | 86.15 | 7.98 |

TABLE II-continued

| Heap Leach Test Field Trial at a Midwestern Mining Facility | | | | |
|---|---|---|---|---|
| Treatment | Hrs | Mls | % Cu | Days |
| 0.9C/0.1G | 261 | 16473 | 88.54 | 10.89 |

A = 70/30 mole ratio poly(acrylamide/sodium acrylate), 20–22,000,000 MW; liquid anionic polymer
B = poly(acrylamide); liquid nonionic polymer
C = 70/30 mole ratio poly(acrylamide/sodium acrylate), 25–30,000,000 MW; liquid anionic polymer
D = 60/40 mole ratio poly(acrylamide/sodium acrylate), 25–30,000,000 MW; liquid anionic polymer
E = 50/50 mole ratio poly(diallyldimethylammonium chloride/acrylamide) 1–1,500,000 MW; latex cationic polymer
F = 90/10 mole ratio poly(acrylamide/diallyldimethylammonium chloride) 10–15,000,000 MW: latex cationic polymer
G = 20% solution poly(diallyldimethylammonium chloride), liquid cationic polymer, 30–150,000 MW

EXAMPLE 3

Laboratory evaluations of copper heap leach agglomeration aid efficiency were tested in the following manner. 40 lbs of copper ore (obtained from a midwestern mining facility) were placed in a cement mixer. The polymeric treatment to be tested was added to 900 mls of water, and this solution was then added to the mixing ore. 545 g of concentrated sulfuric acid was then added to the mixing ore, and then the ore was further mixed. The treated ore was placed in a 6" internal diameter, 5' high PVC column capped at the bottom with a 1 inch spout, and allowed to age for two days. After 2 days, 10 g/L sulfuric acid extractant was added to the column at a rate of 4 mls/min. The leachant was collected from the bottom of the column and analyzed to determine how much copper had been extracted, at one to two day intervals. At the end of the test period, the contents of the column were recovered and analyzed by a tailings assay for remaining acid soluble copper to determine how much copper remained on the column, and had not been leached out.

The above procedure was utilized to obtain the results of Table III. The term "break" indicates the number of minutes it takes from the time the extractant flows through the bottom of the column from the time the extractant was started on the top of the ore in the column. A low number for break indicates that there is good flow through the column. "None" indicates no flow or column plugging, due to fine particle migration or clay swelling. A positive result (a good agglomeration aid) is indicated when there is extractant flow and reduced slump. Polymers M and G were not tested alone, because it is well known that low molecular weight cationic polymers acting alone will not have an effect in these systems. The C/G combination showed reduced slump, over a sole treatment of C.

TABLE III

| Polymer | Dose (lbs/Ton) | % Slump at 11 min. | % Slump at 15 Min. | Break |
|---|---|---|---|---|
| None | 0 | 20.3 | 31.2 | None |
| B | 0.25 | 12.5 | 20.3 | None |
| B | 0.5 | 12.5 | 20.3 | 13.2 |
| B | 1 | 9.4 | 18.8 | 14.2 |
| B | 1.5 | 7.8 | 12.5 | 14.25 |
| B | 2 | 6.2 | 14.1 | 14.5 |
| C | 0.25 | 25 | 31.2 | None |
| C | 1 | 15.6 | 25 | 15.3 |
| D | 1 | 9.4 | 21.9 | None |

TABLE III-continued

| Polymer | Dose (lbs/Ton) | % Slump at 11 min. | % Slump at 15 Min. | Break |
|---|---|---|---|---|
| D | 2 | 6.2 | 12.5 | None |
| I | 1 | 12.5 | 25 | None |
| J | 1 | 12.5 | 25 | None |
| K | 1 | 12.5 | 18.8 | 17.25 |
| F | 1 | 9.4 | 14.1 | 15 |
| H | 0.5 | 7.8 | 15.6 | 15.5 |
| H | 1 | 6.2 | 12.5 | 16.5 |
| H | 1 | 7.8 | 14.1 | None |
| L | 1 | 4.7 | 12.5 | 16 |
| 0.9 C/0.1 M | 1 | 12.5 | 21.9 | 14.8 |
| 0.9 C/0.1 G | 1 | 12.5 | 20.3 | None |
| 0.9 D/0.1 G | 1 | 12.5 | 25 | None |
| 0.9 B/0.1 G | 1 | 6.2 | 15.6 | 14.25 |
| 0.5 B/0.5 F | 1 | 6.2 | 14.1 | 14.5 |
| None | 0 | 18.8 | 31.2 | None |

B = poly(acrylamide); liquid nonionic polymer
C = 70/30 mole ratio poly(acrylamide/sodium acrylate), 25–30,000,000 MW; liquid anionic polymer
D = 60/40 mole ratio poly(acrylamide/sodium acrylate), 25–30,000,000 MW; liquid anionic polymer
F = 90/10 mole ratio poly(acrylamide/diallyldimethylammonium chloride) 10–15,000,000 MW; latex cationic polymer
G = 20% solution poly(diallyldimethytammonium chloride) 30–150,000 MW, liquid cationic polymer
H = poly(acrylamide); dry nonionic polymer
I = 25/75 mote ratio poly(acrylamide/sodium acrylate), 25-30,000,000 MW, liquid anionic polymer
J = poly(acrylic acid), 15–20,000,000 MW; liquid anionic polymer
K = 30/70 mole ratio poly(diallyldimethylammonium chloride/acrylamide), 20–25,000,000 MW, liquid cationic polymer
L = 20/80 mole ratio poly(diallyldimethylammonium chloride/acrylamide), 5–10,000,000 MW, dry cationic polymer
M = 99/1 mole ratio poly(diallyldimethylammonium chloride/vinyltrimethoxysilane, liquid cationic polymer, ~1,000,000 MW Changes can be made in the composition, operation and arrangement of the method of the present invention described herein without departing from the concept and scope of the invention as defined in the following claims:

I claim:

1. In a process for percolation leaching of minerals from a mineral bearing ore wherein the ore is first agglomerated with an agglomeration agent in an agglomerating step, the agglomerated ore is formed into a heap and then leached by percolating a leaching solution through the heap which extracts the minerals from the agglomerated ore for subsequent recovery, the improvement in which the agglomerating step comprises sequential addition of a first water-soluble polymer selected from the group consisting of anionic and nonionic water-soluble polymers, and then a second cationic water-soluble polymer to said ore.

2. The process of claim 1 wherein said first polymer is formed from the polymerization of monomers of (meth) acrylic acid with monomers selected from the group consisting of acrylonitrile, acrylic acid and salts thereof, methacrylamide and salts thereof, $C_1$–$C_{10}$ N-alkyl acrylamide, $C_1$–$C_{10}$ N,N-dialkyl acrylamide, $C_1$–$C_{10}$ N-alkyl methacrylamide, $C_1$–$C_{10}$ N,N-dialkyl methacrylamide, N-aryl acrylamide, N,-N-diaryl acrylamide, N-aryl methacrylamide, N-N-diaryl methacrylamide, N-arylalkyl acrylamide, N,N-diallylalkyl acrylamide, N-arylalkyl methacrylamide, N,N-diarylalkyl methacrylamide, maleic anhydride, itaconic acid, vinyl sulfonic acid, styrene sulfonic acid, sodium acrylamido methyl propane sulfonic acid, maleic acid and combinations thereof.

3. The process of claim 1 wherein said second polymer is formed from the polymerization of monomers of (meth) acrylamide with monomers selected from the group consisting of 2-acryloyloxyethyl trimethyl ammonium chloride, 3-methacrylamido propyl trimethyl ammonium chloride, 2-methacryloyloxyethyl trimethyl ammonium chloride, vinyl acetate, diallyldimethyl ammonium chloride, vinyl pyrrolidinone, acrylonitrile, dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, dimethylaminoethylmethacrylate methyl sulfate quaternary salt, and combinations thereof.

4. The process of claim 1 wherein said second polymer is a homopolymer formed from the polymerization of monomers selected from the group consisting of: diallyldimethylammonium chloride, dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, and dimethylaminoethylmethacrylate methyl sulfate quaternary salt.

5. The process of claim 1 wherein said second polymer is selected from the group consisting of a polymeric reaction product of ethylenedichloride and ammonia including the associated methyl chloride and dimethyl sulfate quaternary amine salts; a polymeric reaction product of epichlorohydrin and dimethylamine; a polymeric reaction product of epichlorohydrin, dimethylamine and ethylenediamine including the associated methyl chloride or methyl sulfate quaternary amine salts; a polymeric reaction product of epichlorohydrin, dimethylamine and ammonia including the associated methyl chloride or methyl sulfate quaternary amine salts; a polymeric reaction product of epichlorohydrin, dimethylamine hexamethylenediamine including the associated methyl chloride or methyl sulfate quaternary amine salts; guanidine-formaldehyde condensation polymers; cyanoguanidine-formaldehyde condensation polymers; urea-formaldehyde condensation polymers and polyethyleneimines.

6. The process of claim 1 wherein said first polymer is poly(acrylamide).

7. The process of claim 1 wherein said first polymer is poly(acrylamide/sodium acrylate) and said second polymer is poly(diallyldimethylammonium chloride).

8. The process of claim 1 wherein said first polymer is poly(acrylamide/sodium acrylate) and said second polymer is poly(diallyldimethylammonium chloride/vinyltrimethoxysilane).

9. The process of claim 1 wherein said first polymer is poly(acrylamide) and said second polymer is poly (diallyldimethylammonium chloride/acrylamide).

10. The process of claim 1 wherein the amount of agglomerating agent is in the range of about 0.05 to about 1.0 pounds per ton based on the weight of the ore.

11. The process of claim 1 wherein the amount of agglomerating agent is in the range of about 0.1 to about 0.3 pounds per ton based on the weight of the ore.

12. The process of claim 1 wherein said ore is selected from the group consisting of gold, silver and copper ores.

13. The process of claim 12 wherein said ore is gold ore and said agglomerating agent is combined with at least 1 to 30 pounds per ton of cement based on the weight of the ore.

14. The process of claim 1 wherein said second water-soluble polymer is added before addition of said first water-soluble polymer to said ore.

15. In a process for percolation leaching of copper from a copper bearing ore wherein the ore is first agglomerated with an agglomeration agent in an agglomerating step, the agglomerated ore is formed into a heap and then leached by percolating a leaching solution through the heap which extracts the copper from the agglomerated ore for subsequent recovery, the improvement in which the agglomerating step comprises a sequential addition of a first water-soluble polymer, selected from the group consisting of anionic and nonionic water-soluble polymers, and then a second cationic water-soluble polymer to said ore.

16. The process of claim 15 wherein said first polymer is formed from the polymerization of monomers of (meth) acrylic acid with monomers selected from the group consisting of acrylonitrile, acrylic acid and salts thereof, methacrylamide and salts thereof, $C_1$–$C_{10}$ N-alkyl acrylamide, $C_1$–$C_{10}$ N,N-dialkyl acrylamide, $C_1$–$C_{10}$ N-alkyl methacrylamide, $C_1$–$C_{10}$ N, N-dialkyl methacrylamide, N-aryl acrylamide, N,-N-diaryl acrylamide, N-aryl methacrylamide, N-N-diaryl methacrylamide, N-arylalkyl acrylamide, N,N-diallylalkyl acrylamide, N-arylalkyl methacrylamide, N,N-diarylalkyl methacrylamide, maleic anhydride, itaconic acid, vinyl sulfonic acid, styrene sulfonic acid, sodium acrylamido methyl propane sulfonic acid, maleic acid and combinations thereof.

17. The process of claim 15 wherein said second polymer is formed from the polymerization of monomers of (meth) acrylamide with monomers selected from the group consisting of 2-acryloyloxyethyl trimethyl ammonium chloride, 3-methacrylamido propyl trimethyl ammonium chloride, 2-methacryloyloxyethyl trimethyl ammonium chloride, vinyl acetate, diallyldimethyl ammonium chloride, vinyl pyrrolidinone, acrylonitrile, dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, dimethylaminoethylmethacrylate methyl sulfate quaternary salt, and combinations thereof.

18. The process of claim 15 wherein said second polymer is a homopolymer formed from monomers selected from the group consisting of: diallyldimethylammonium chloride, dimethylaminoethyl acrylate methyl chloride quaternary salt, dimethylaminoethyl acrylate benzyl chloride quaternary salt, dimethylaminoethyl acrylate methyl sulfate quaternary salt, dimethylaminoethyl acrylate cetyl chloride quaternary salt, dimethylaminoethyl methacrylate cetyl chloride quaternary salt, dimethylaminoethylmethacrylate methyl chloride quaternary salt, dimethylaminoethylmethacrylate benzyl chloride quaternary salt, and dimethylaminoethylmethacrylate methyl sulfate quaternary salt.

19. The process of claim 15 wherein said second polymer is selected from the group consisting of a polymeric reaction product of ethylenedichloride and ammonia including the associated methyl chloride and dimethyl sulfate quaternary amine salts; a polymeric reaction product of epichlorohydrin and dimethylamine; a polymeric reaction product of epichlorohydrin, dimethylamine and ethylenediamine including the associated methyl chloride or methyl sulfate quaternary amine salts; a polymeric reaction product of epichlorohydrin, dimethylamine and ammonia including the associated methyl chloride or methyl sulfate quaternary amine salts; a polymeric reaction product of epichlorohydrin, dimethylamine hexamethylenediamine including the associated methyl chloride or methyl sulfate quaternary amine salts; guanidine-formaldehyde condensation polymers; cyanoguanidine-formaldehyde condensation polymers; urea-formaldehyde condensation polymers and polyethyleneimines.

20. The process of claim 15 wherein said first polymer is poly(acrylamide).

21. The process of claim 15 wherein said first polymer is poly(acrylamide/sodium acrylate) and said second polymer is poly(diallyldimethylammonium chloride).

22. The process of claim 15 wherein said first polymer is poly(acrylamide/sodium acrylate) and said second polymer is poly(diallyldimethylammonium chloride/vinyltrimethoxysilane).

23. The process of claim 15 wherein said first polymer is poly(acrylamide) and said second polymer is poly (diallyldimethylammonium chloride/acrylamide).

24. The process of claim 15 wherein the amount of agglomerating agent is in the range of about 0.05 to 1.0 pounds per ton based on the weight of the ore.

25. The process of claim 15 wherein the amount of agglomerating agent is in the range of about 0.1 to about 0.3 pounds per ton based on the weight of the ore.

26. The process of claim 15 wherein said second water-soluble polymer is added before addition of said first water-soluble polymer to said ore.

* * * * *